US009162347B2

(12) United States Patent
Huang

(10) Patent No.: US 9,162,347 B2
(45) Date of Patent: Oct. 20, 2015

(54) ADJUSTABLE WRENCH

(71) Applicant: New Way Tools Co., Ltd., Taichung (TW)

(72) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 249 days.

(21) Appl. No.: 13/737,130

(22) Filed: Jan. 9, 2013

(65) Prior Publication Data

US 2013/0247725 A1 Sep. 26, 2013

(30) Foreign Application Priority Data

Mar. 21, 2012 (TW) ..... 101109651 A

(51) Int. Cl.
*B25B 13/16* (2006.01)
*B25B 13/14* (2006.01)
*B25B 13/46* (2006.01)

(52) U.S. Cl.
CPC ..... *B25B 13/16* (2013.01); *B25B 13/14* (2013.01); *B25B 13/46* (2013.01)

(58) Field of Classification Search
CPC ..... B25B 13/12; B25B 13/14; B25B 13/16; B25B 13/46; B25B 13/467; B25B 13/5041; B25B 13/5058
USPC ..... 81/126, 165
See application file for complete search history.

(56) References Cited

U.S. PATENT DOCUMENTS

| | | | | |
|---|---|---|---|---|
| 3,712,356 | A * | 1/1973 | Petroshanoff | 411/208 |
| 6,336,384 | B1 * | 1/2002 | Huang | 81/165 |
| 7,137,321 | B1 * | 11/2006 | Huang | 81/126 |
| 8,136,429 | B2 | 3/2012 | Wu | |
| 2010/0263498 | A1 * | 10/2010 | Huang | 81/170 |
| 2011/0061500 | A1 * | 3/2011 | Huang | 81/474 |

FOREIGN PATENT DOCUMENTS

TW M352428 U 3/2009

* cited by examiner

*Primary Examiner* — Hadi Shakeri
(74) *Attorney, Agent, or Firm* — Alan D. Kamrath; Kamrath IP Lawfirm, P.A.

(57) ABSTRACT

An adjustable wrench includes a handle including a notch defined therein. A driving head is pivotally fixed to the handle for engaging an object that is driven by the adjustable wrench. The driving head and the handle include first and second springs engaged therebetween. The first and second springs each include a first end abutting against the handle and a second end abutted against the driving head, respectively. The notch receives the first and second springs. Coils of the second spring are disposed within a space delimited by the coils of the first spring. One of the first and second springs is coiled clockwise from the first end to the second end thereof, and the other of the first and second springs is coiled counterclockwise from the first end to the second end thereof.

20 Claims, 10 Drawing Sheets

ADJUSTABLE WRENCH

BACKGROUND OF THE INVENTION

1. Field of the Invention

The present invention relates to an adjustable wrench and, in particular, to an adjustable wrench for quickly turning an object.

2. Description of the Related Art

U.S. Pat. No. 6,336,384 shows an adjustable wrench for quickly turning an object. The adjustable wrench includes a handle and a driving head pivotally connected together. A spring is installed between the handle and the driving head. The handle and the driving head can reciprocally pivot with each other, and the spring is selectively depressed and released by the driving head and the handle. Thereby, the spring aids the driving head to reciprocally pivot with respect to the handle. Unfortunately, the spring becomes fatigue and distorted after repetitive movements of the driving head with respect to the handle.

The present invention is, therefore, intended to obviate or at least alleviate the problems encountered in the prior art.

SUMMARY OF THE INVENTION

According to the present invention, an adjustable wrench includes a handle for a user to grasp when operating the adjustable wrench having an outer periphery thereof including a notch defined therein. A driving head is pivotally fixed to the handle for engaging an object that is driven by the adjustable wrench. The driving head and the handle include first and second springs engaged therebetween. The first and second springs each include a first end abutting against the handle and a second end abutted against the driving head, respectively. The notch receives the first and second springs. Coils of the second spring are disposed within a space delimited by coils of the first spring. One of the first and second springs is coiled clockwise from the first end to the second end thereof, and the other of the first and second springs is coiled counterclockwise from the first end to the second end thereof.

The adjustable wrench is operable in a first direction wrenching the object and including the driving head not moving relative to the handle, and in a second direction moving relative to the object and including the driving head pivotally moving relative to the handle and the first and second springs assisting relative movement therebetween.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an objective of the present invention to provide an adjustable wrench for quickly turning an object and usable in a circumstance which requires a relatively large torque to turn the object.

It is another objective of the present invention that the first and second springs set forth above better assist relative movements of the handle with respect to the driving head, and they will not become distorted easily.

Other objectives, advantages, and new features of the present invention will become apparent from the following detailed description of the invention when considered in conjunction with the accompanied drawings.

DETAILED DESCRIPTION OF THE INVENTION

Figure 1:
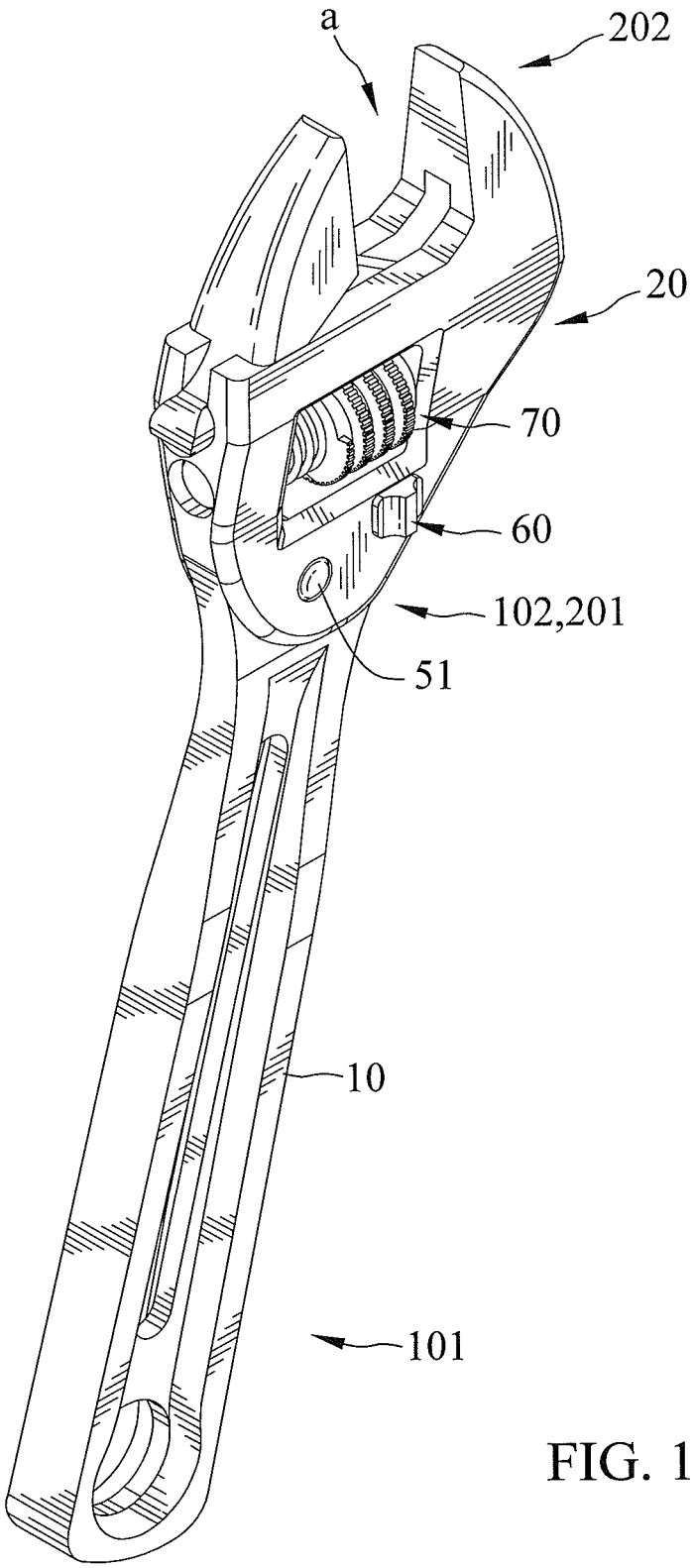
FIG. 1 is a perspective view of an adjustable wrench in accordance with the present invention.
Figure 2:
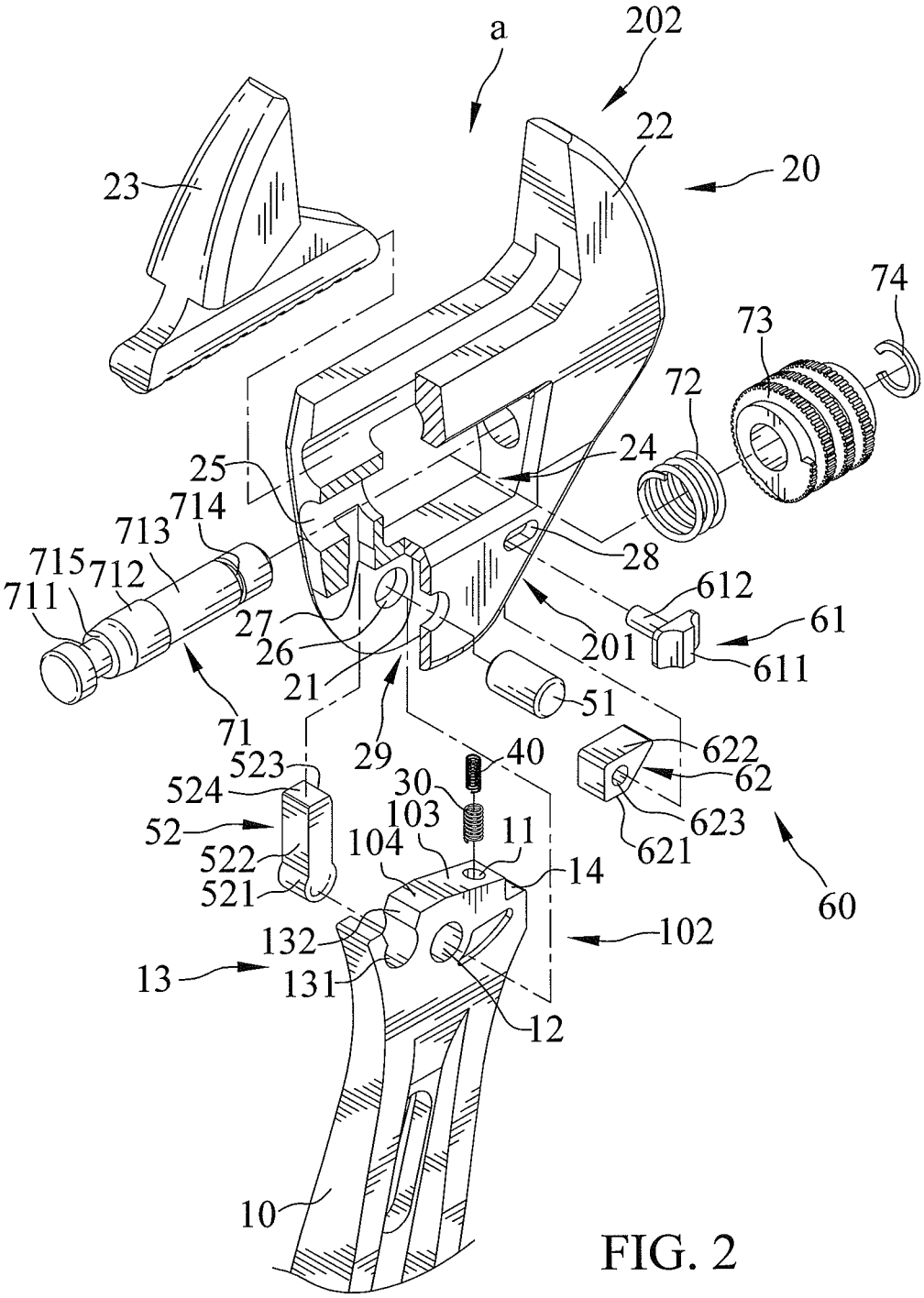
FIG. 2 is an exploded perspective view of the adjustable wrench of FIG. 1.
Figure 3:
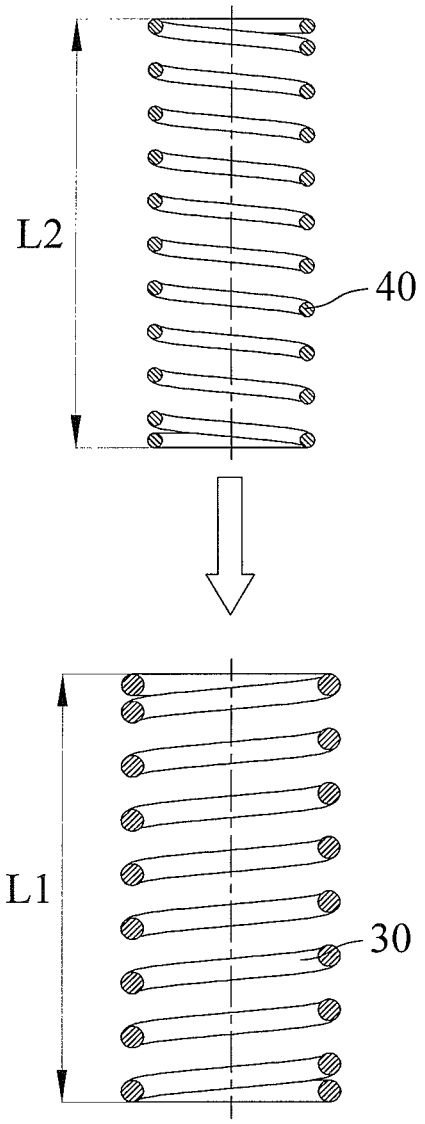
FIG. 3 is a partial cross-sectional view showing the adjustable wrench of FIG. 1 including two springs, with one spring adapted to be insertably installed within the other spring.
Figure 4:
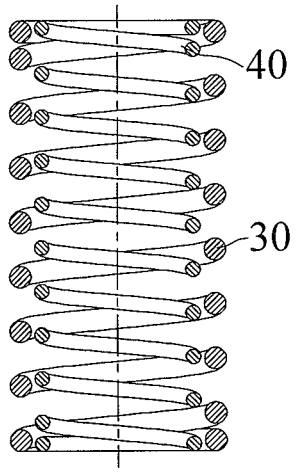
FIG. 4 is an extended cross-sectional view of FIG. 3, showing one spring disposed within the other spring.
Figure 5:
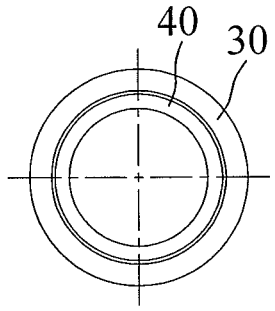
FIG. 5 is a top view of FIG. 4, showing one spring disposed within the other spring.
Figure 6:
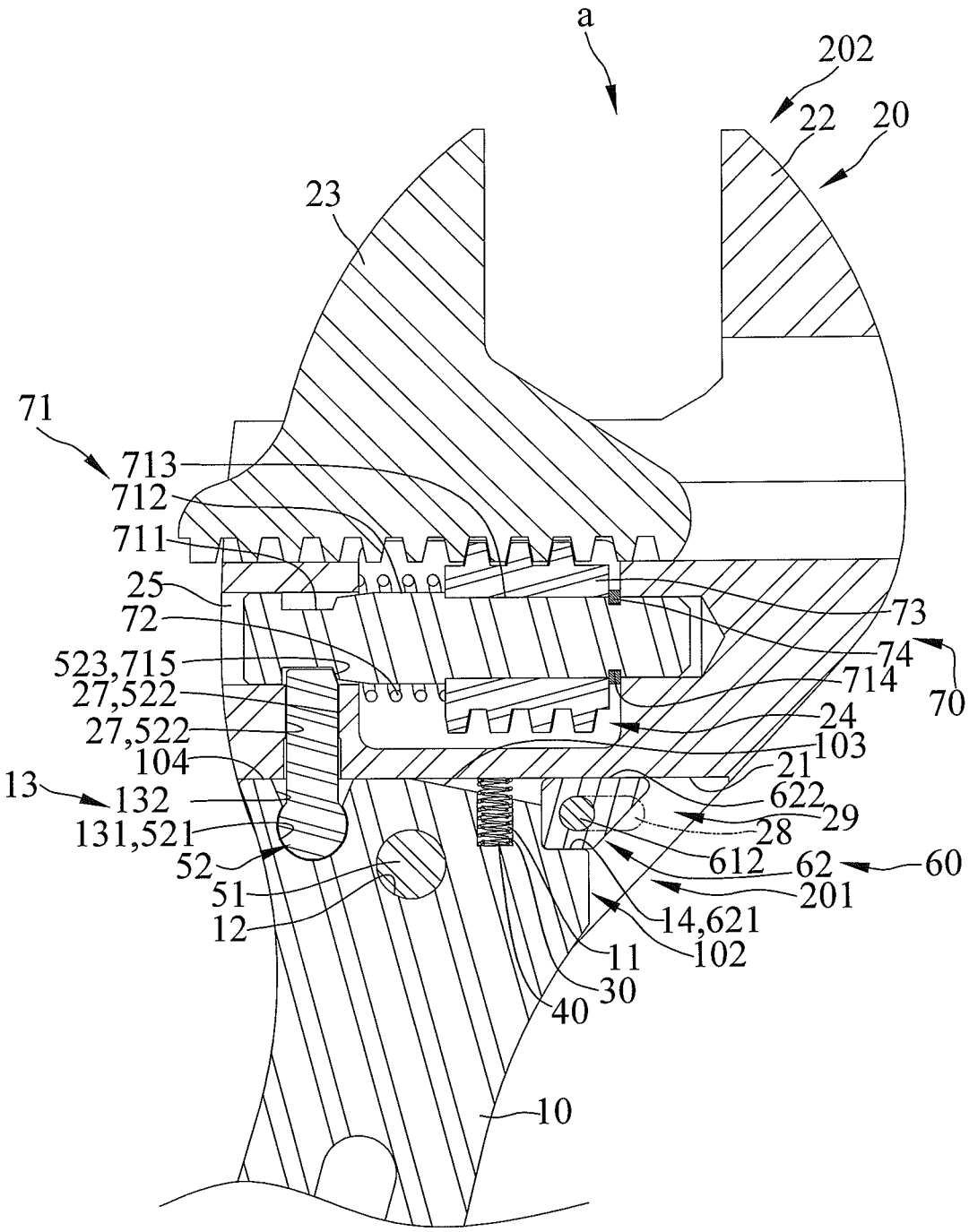
FIG. 6 is a cross-sectional view of the adjustable wrench of FIG. 1.
Figure 7:
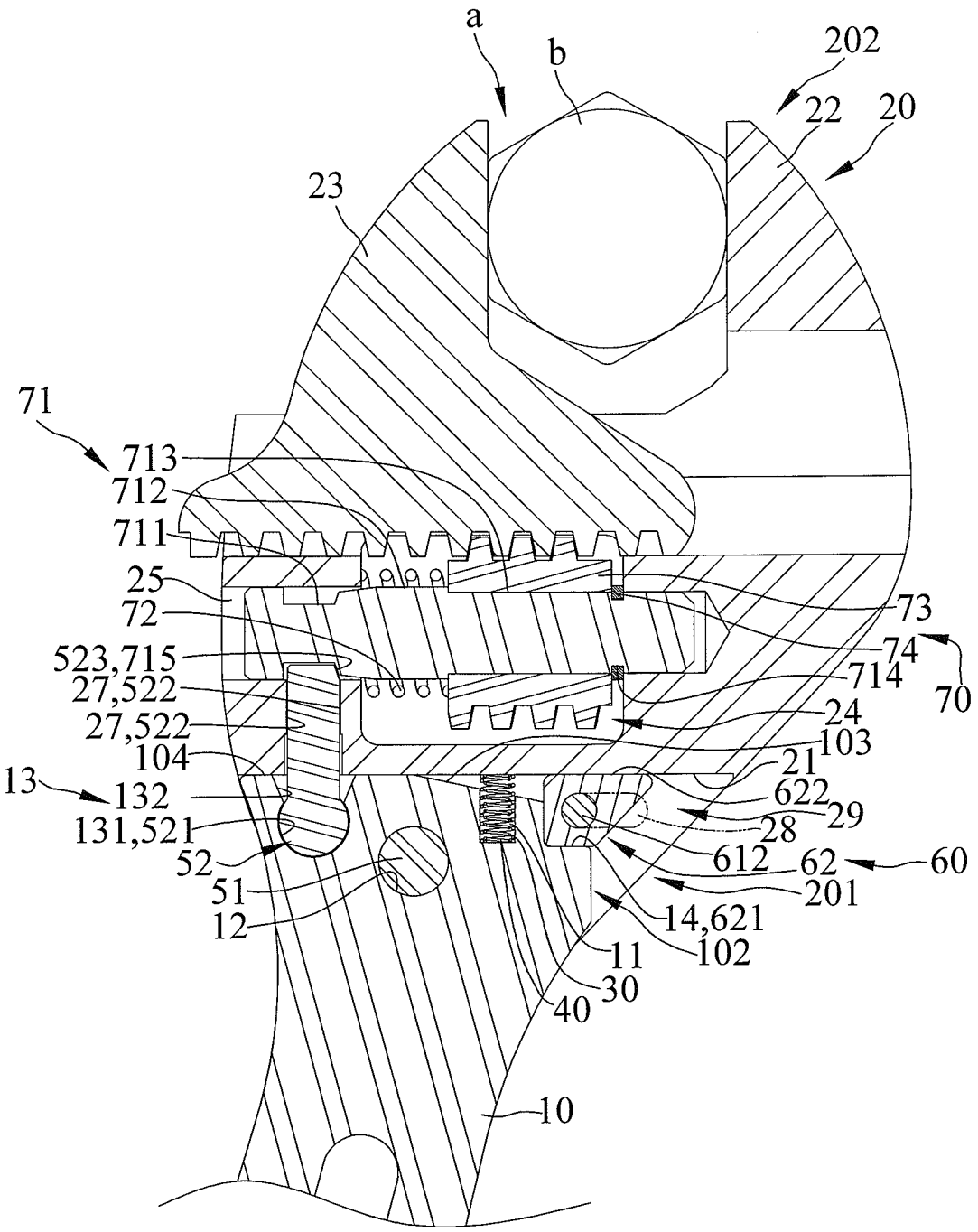
FIG. 7 is a continued view of FIG. 6, showing an object held in a driving head of the adjustable wrench, with the object shown in phantom.
Figure 8:
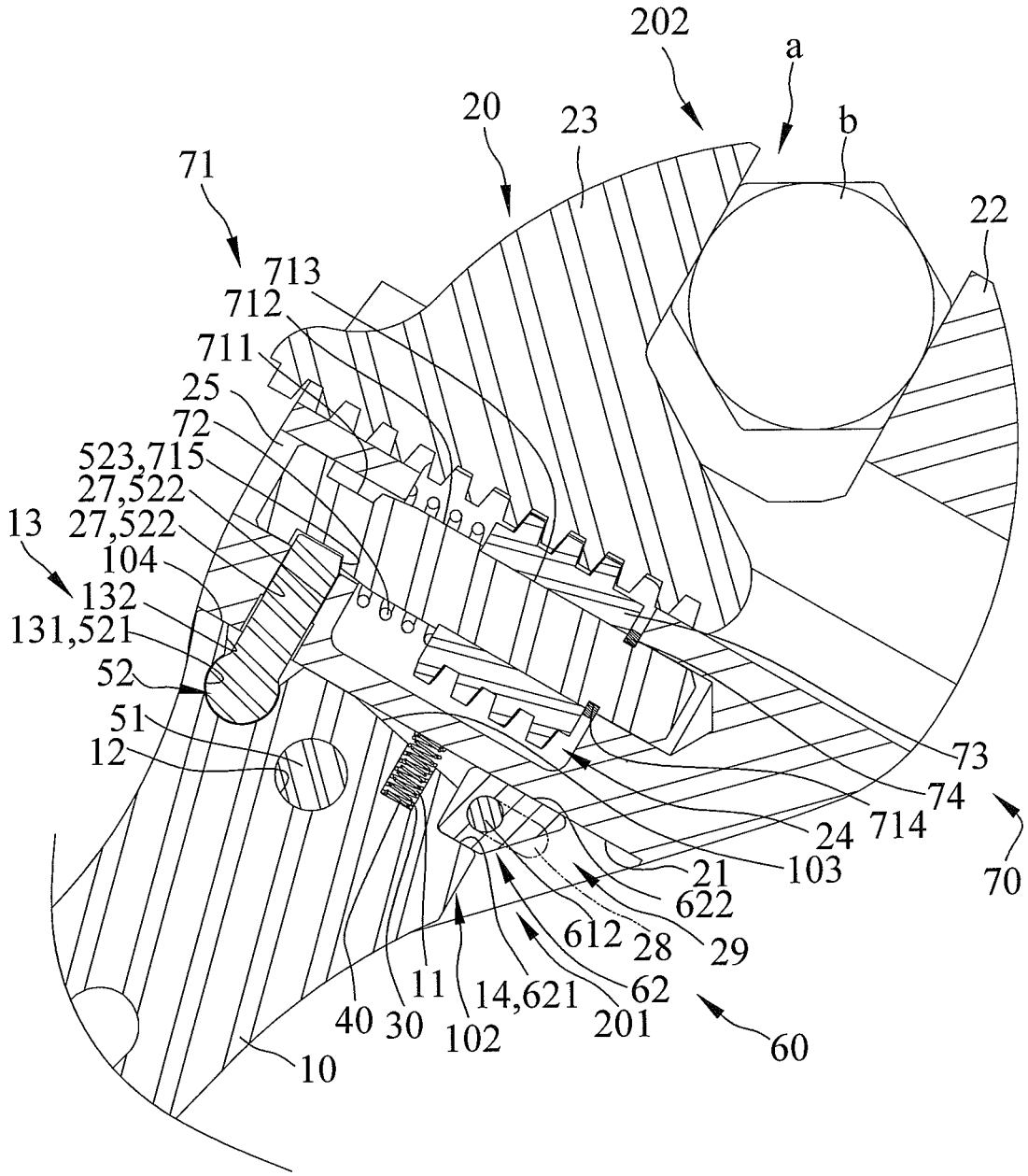
FIG. 8 is a continued view of FIG. 7, showing the object rotated to a position different from that of FIG. 7 by operating the adjustable wrench in a first operating direction.
Figure 9:
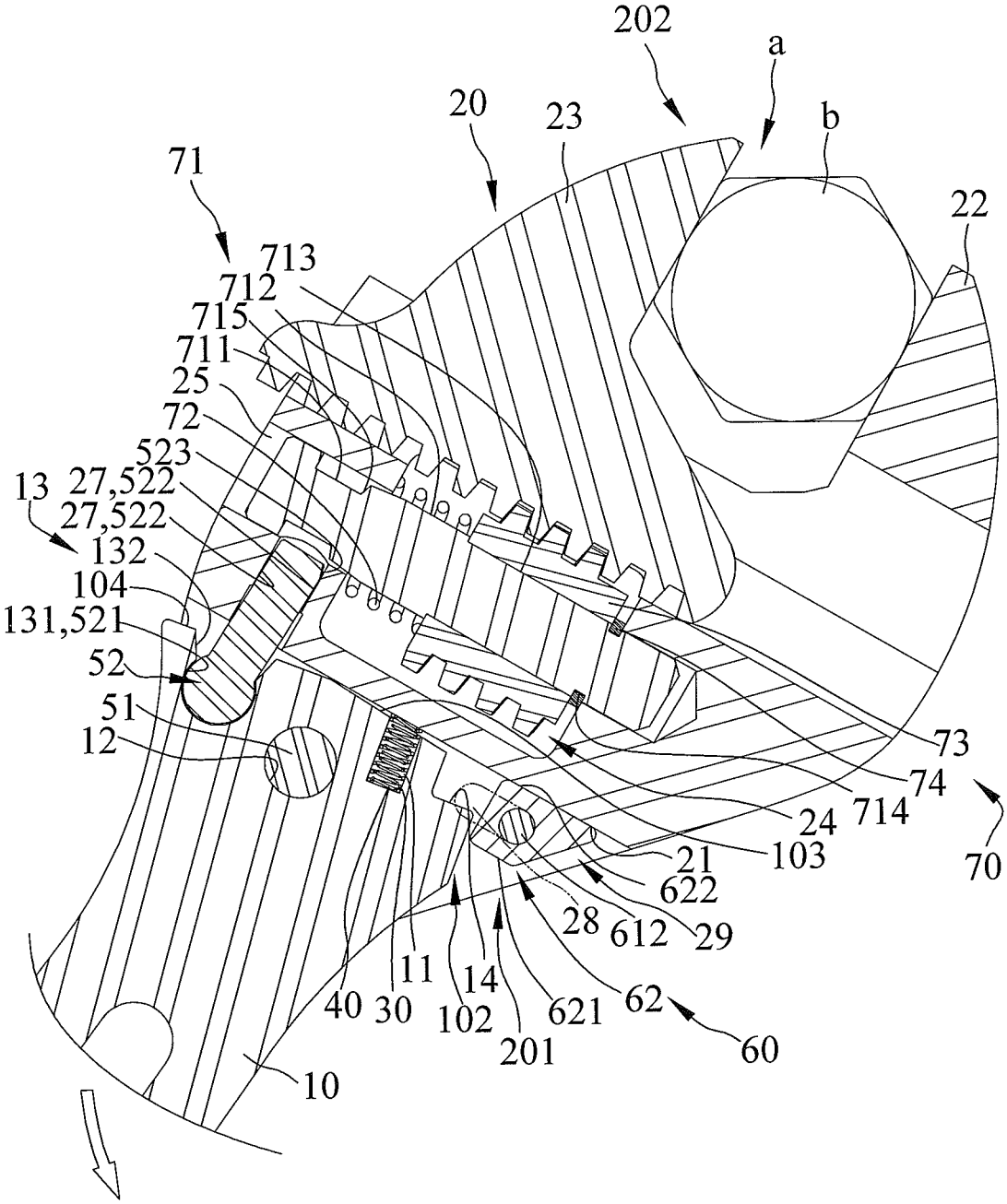
FIG. 9 is a continued view of FIG. 8, showing the operation of the adjustable wrench in a second operating direction moving relative to the object engaged therewith.
Figure 10:
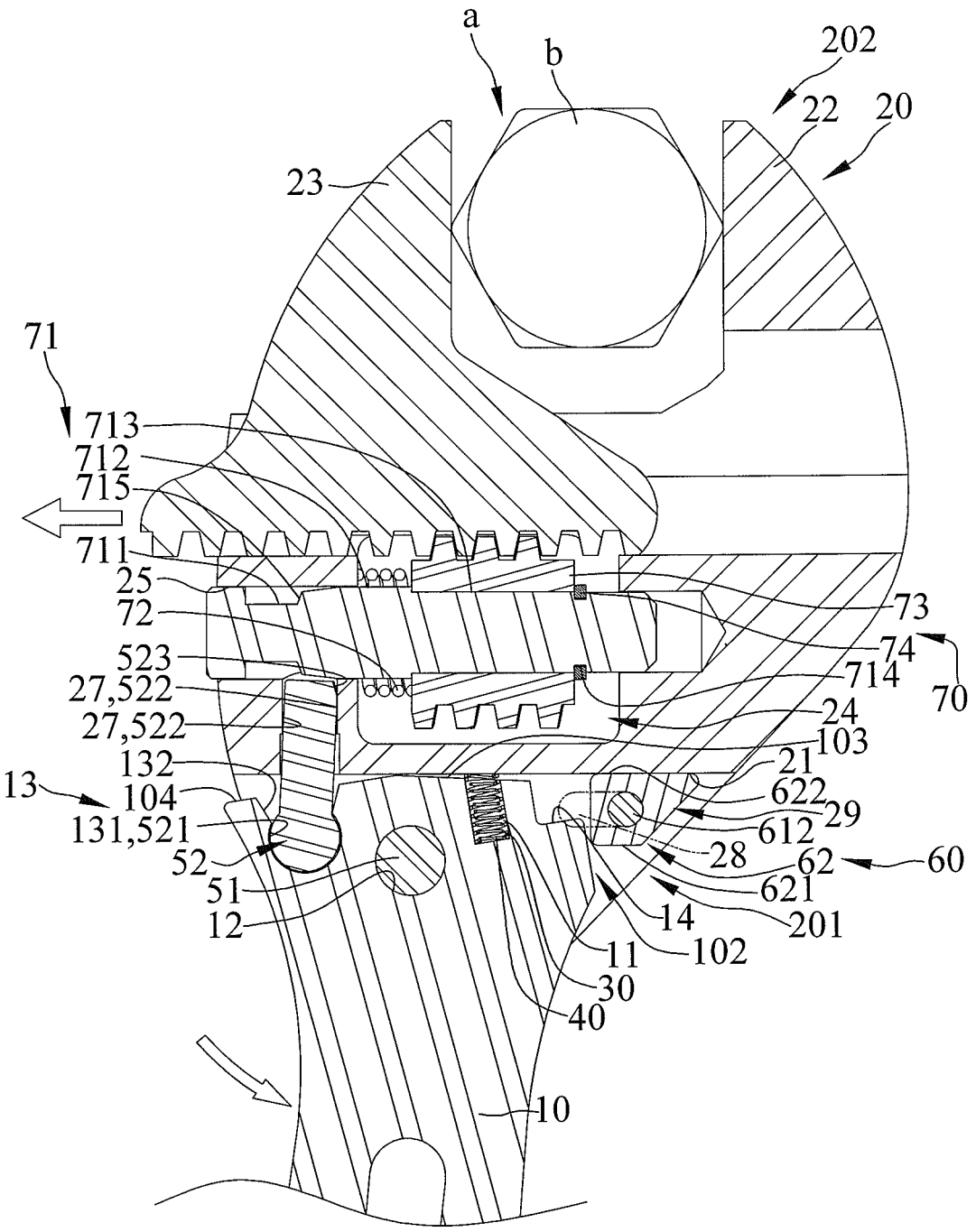
FIG. 10 is a continued view of FIG. 9, showing the operation of the adjustable wrench in the second operating direction moving relative to the object engaged therewith and the adjustable wrench in a relative position with respect to the object different from that of FIG. 9.
Figure 11:
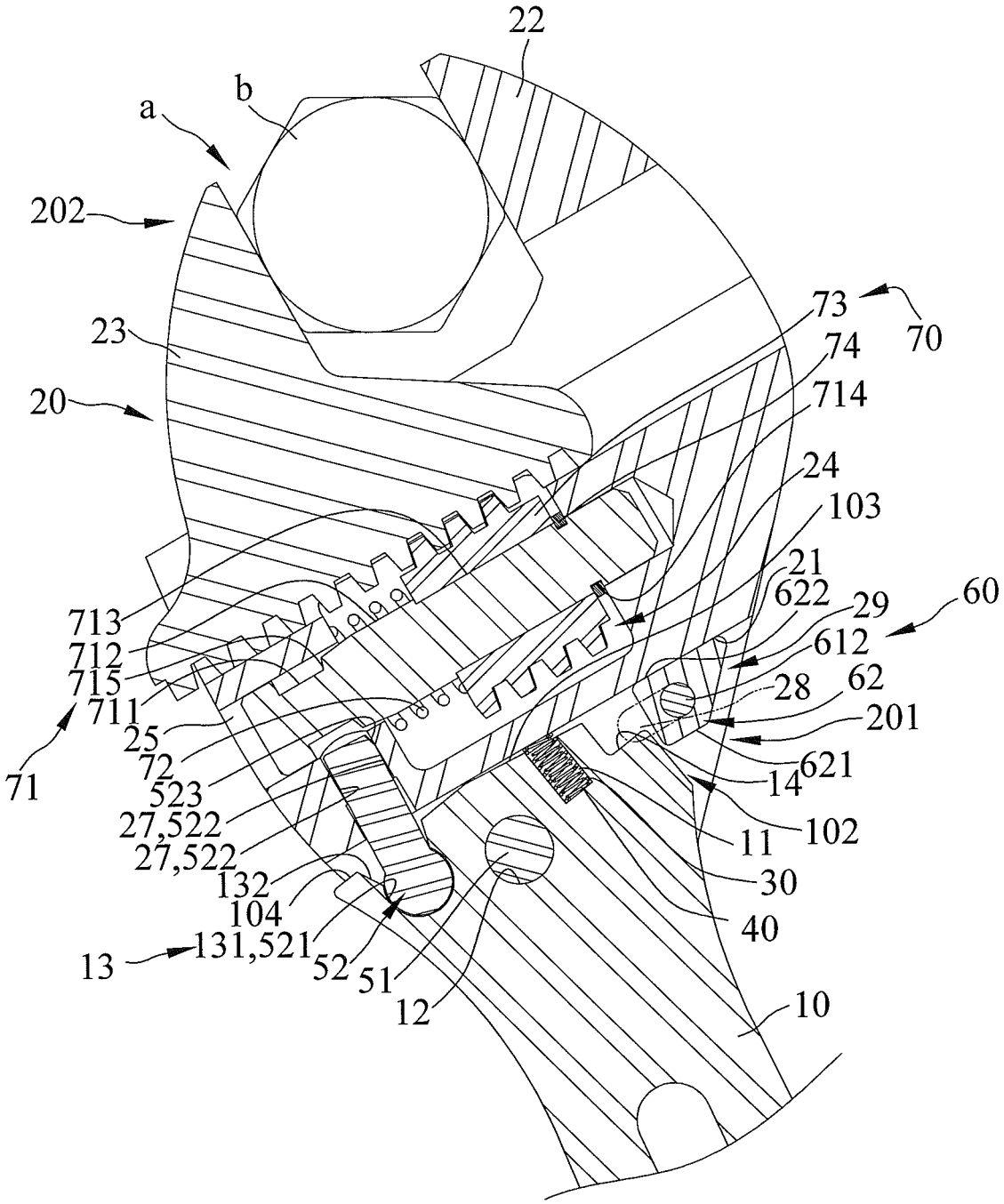
FIG. 11 is a continued view of FIG. 10, showing the operation of the adjustable wrench in the second operating direction moving relative to the object engaged therewith and the adjustable wrench in a relative position with respect to the object different from that of FIG. 10.
Figure 12:
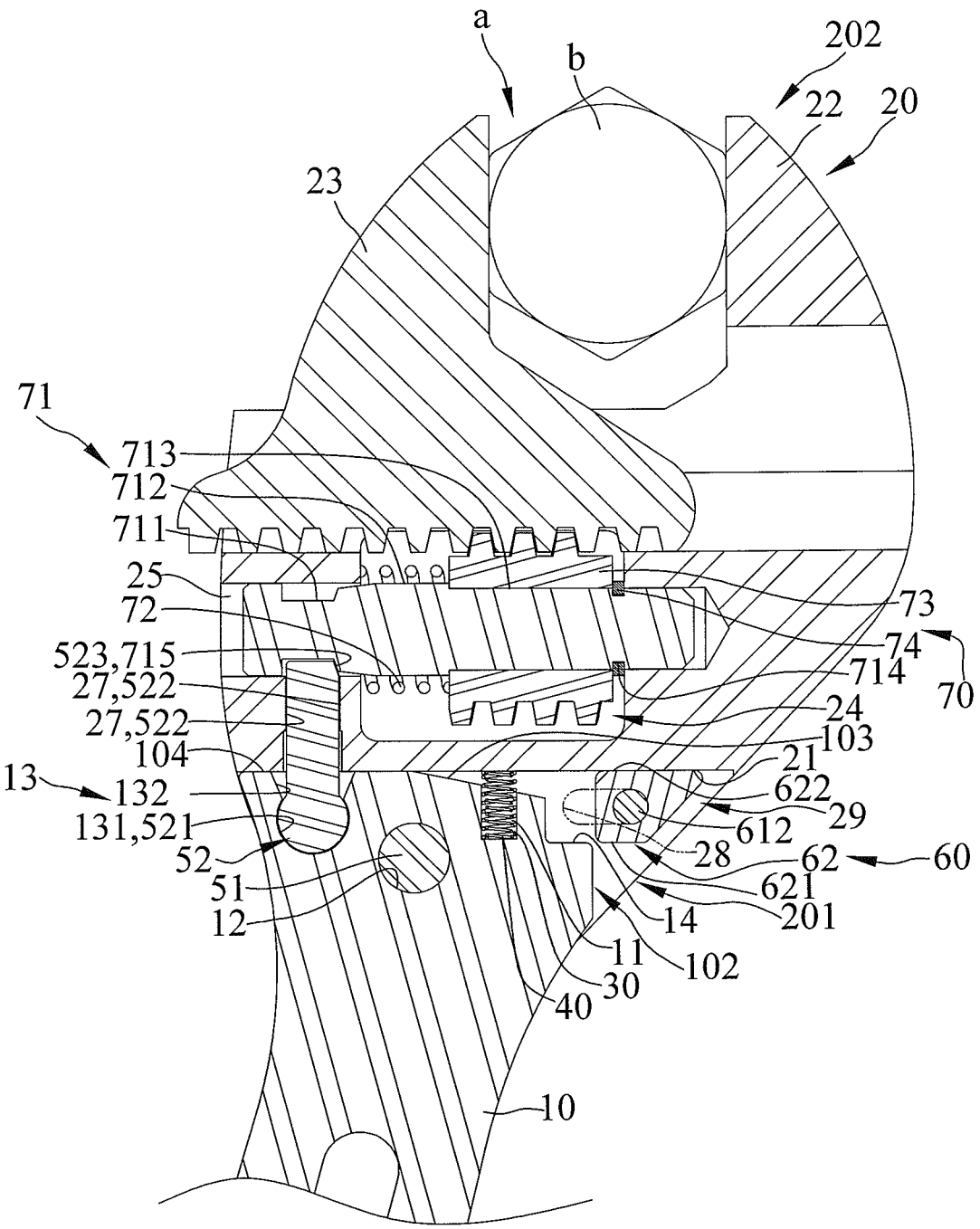
FIG. 12 is a continued view of FIG. 11, showing the object rotated to a position same as that of FIG. 7 by operating the adjustable wrench in the first operating direction.

FIGS. 1 through 12 show an adjustable wrench in accordance with a first embodiment of the present invention. The adjustable wrench includes a handle 10, a driving head 20, a first spring 30, and a second spring 40.

The handle 10 for a user to grasp when operating the adjustable wrench has an outer periphery thereof including a notch 11 defined therein. The handle 10 defines a grasping end 101 and a connecting end 102. The handle 10 has the outer periphery defining an abutting edge which defines a first abutting surface 103 and a second abutting surface 104 and includes the notch 11 defined therein. The first abutting surface 103 is oblique to the second abutting surface 104. The handle 10 also includes a first orifice 12, a concavity 13, and a recess 14 defined therein. The concavity 13 is defined on the connecting end 102 of the handle 10. The concavity 13 has an arcuate section 131 and two inclined section 132 extended from two distal ends of the arcuate section 131, respectively, to the outer periphery of the handle 10. The recess 14 is inset into the first abutting surface 103.

The driving head 20 is pivotally fixed to the handle 10 and includes a fixed jaw 22 and a movable jaw 23. The fixed jaw 22 has a first end 201 and a second end 202 opposite to the first end 201. The fixed jaw 22 has the first end 201 thereof pivotally fixed to the connecting end 102 of the handle 10. The movable jaw 23 is movably received in the second end 202 of the fixed jaw 22. A space a is defined between the fixed jaw 22 and the movable jaw 23, and an object b that is to be driven by the adjustable wrench is disposed in the space a. The driving head 20 has an abutting side 21 opposite the abutting edge of the handle 10. The abutting side 21 abuts against the second abutting surface 104. The driving head 20 includes a chamber 24 and a hole 25 defined therein. The hole 25 is extended from the chamber 24 to an outer periphery of the fixed jaw 22. The driving head 20 includes a second orifice 26, a channel 27, and a slot 28 defined therein. The handle 10 and the driving head 20 are pivotally joined together about a pivot 51. The pivot 51 is engaged in the first and second orifices 12 and 26. The pivot 51 is inserted trough where the handle 10 and the driving head 20 overlap. One of the handle 10 and the driving head 20 has two sides and a gap 29 defined therebetween, while the other of the handle 10 and the driving head 20 includes a protrusion received in the gap 29 and overlapped with the sides delimiting the gap 29.

The driving head 20 and the handle 10 include first and second springs 30 and 40 engaged therebetween. The first and second springs 30 and 40 each include a first end abutting against the handle 10 and a second end abutted against the driving head 20, respectively. The notch 11 receives the first and second springs 30 and 40. Coils of the second spring 40 are disposed within a space delimited by coils of the first spring 30, and one of the first and second springs 30 and 40 is coiled clockwise from the first end to the second end thereof, while the other of the first and second springs 30 and 40 is coiled counterclockwise from the first end to the second end thereof. The abutting side 21 of the driving head 20 abuts against the first and second springs 30 and 40 extended out of the first abutting surface. The first spring 30 has a first longitudinal length L1 when it is released (not depressed). The second spring 40 has a second longitudinal length L2 when it is released (not depressed). The first and second longitudinal lengths L1 and L2 are equal.

An adjusting mechanism 70 is disposed in the chamber 24. The adjusting mechanism 70 includes a fixing member 71, a first biasing member 72, a worm gear 73, and a clip 74. The adjusting mechanism 70 is engaged with the movable jaw 23 and operably movable to move the movable jaw 23 to a predetermined position with respect to the fixed jaw 22. The fixing member 71 is inserted through the hole 25 and moveably retained in the chamber 24 and the hole 25. The worm gear 73 is mounted on the fixing member 71, and the fixing member 71 is inserted in the worm gear 73. The worm gear 73 is rotatable about and movable along the fixing member 71. The first biasing member 72 has one end engaged with the worm gear 73 and another end abutted against a wall of the chamber 24. The worm gear 73 is engaged with the movable jaw 23. The movable jaw 23 moves linearly relative to the fixed jaw 22 upon rotating the worm gear 73. The clip 74 is mounted on the fixing member 71 and stops the worm gear 73. The first biasing member 72 and the clip 74 are on opposite sides of the worm gear 73. The fixing member 71 has an outer periphery forming a first grooved section 711, a larger peripheral section 712, a smaller peripheral section 713, and a second grooved section 714. The first grooved section 711 has a first external diameter. The fixing member 71 has two segments each having an external diameter greater than the first external diameter and respectively extended from two terminal ends of the first grooved section 711, and the first grooved section 711 is formed adjacent to and between the two segments. The larger peripheral section 712 has a second external diameter. In the embodiment, the larger peripheral section 712 is one of the two segments formed adjacent to the first grooved section 711. Additionally, the larger peripheral section 712 has an end chamfered forming a chamfered edge 715. The chamfered edge 715 is adjacent to the first grooved section 711. The first biasing member 72 is received and corresponds to the larger peripheral section 712. The smaller peripheral section 713 has a third external diameter. The third external diameter is smaller than the second external diameter. The second grooved section 714 has a fourth external diameter. The second grooved section 714 is inset in the smaller peripheral section 713. Therefore, the third external diameter is larger than the fourth external diameter. The clip 74 is received in the second grooved section 714.

The adjustable wrench is operable in a first direction wrenching the object b and including the driving head 20 not moving relative to the handle 10, and in a second direction moving relative to the object b and including the driving head 20 pivotally moving relative to the handle 10 and the first and second springs 30 and 40 assisting relative movement therebetween.

The handle 10 and the driving head 20 include an abutting member 52 engaged therebetween releasably engaged with the adjusting mechanism 70. The abutting member 52 is engaged with the adjusting mechanism 70 when the adjustable wrench is operated in the first direction, while the abutting member 52 is disengaged from the adjusting mechanism 70 when the adjustable wrench is operated in the second direction. The abutting member 52 has an end thereof defining a fixing end 521, two opposite lateral sides thereof defining two first engaging ends 522, and another end thereof opposite to the fixing end 521 defining a second engaging end 524. The abutting member 52 includes the second engaging end 524 engagable with the fixing member 71. The abutting member 52 is pivotally engaged on the handle 10. The arcuate section 131 of the concavity 13 pivotally bears the abutting member 52. The two inclined sections 132 extend divergently from each other towards the outer periphery of the handle 10, thereby allowing the abutting member 52 to have a greater pivotal range. The fixing member 71 is moveably retained in the driving head 20. The abutting member 52 is inserted through the channel 27. The abutting member 52 includes the second engaging end 524 engaged in the first grooved section 711 when the adjustable wrench is operated in the first direction and disengaged from the first grooved section 711 when the adjustable wrench is operated in the second direction, respectively. When the adjustable wrench is operated in the first direction wrenching the object b, the worm gear 73 is stopped from moving along the fixing member 71, and the abutting member 52 includes the second engaging end 524 engaged in the first grooved section 711. Furthermore, when the adjustable wrench is operated in the second direction moving relative to the object, the handle 10 moves with respect to the fixed jaw 22, and the worm gear 73 is adapted to move reciprocally with respect to the fixing member 71, and the abutting member 52 is not received in the first grooved section 711 and movable on the larger peripheral section 712, as well as the movable jaw 23 is movable reciprocally with respect to the fixed jaw 22. Additionally, the abutting member 52 has a chamfered corner 523. The chamfered corner 523 is abutted against the chamfered edge 715 when the adjustable wrench is operated in the first direction. Due to the corners of the abutting member 52 and the first grooved section 711, i.e., the chamfered corner 523 and the chamfered edge 715, the abutting member 52 can easily move out of the first grooved section 711 when the adjustable wrench is operated in the second direction.

A switch mechanism 60 is engaged between the handle 10 and the driving head 20 and operably moveable to a lock position and an unlock position. When the switch mechanism 60 is in the lock position, the adjustable wrench is adapted to be operated clockwise or counterclockwise to wrench the object b, and the driving head 20 is prevented from moving relative to the handle 10. When the switch mechanism 60 is in the unlock position, the adjustable wrench is adapted to be operated in the first direction to wrench the object b and in the second direction to move relative to the object b. The switch mechanism 60 includes a switch member 61 for a user to operate during the operation of the switch mechanism 60 joined to the block 62. The block 62 is disposed in the gap 29. If the switch member 61 is operably moved, the block 62 will move. The block 62 has an outer periphery thereof defining a first abutting edge 621 and a second abutting edge 622 adjacent to the first abutting edge 621. The recess 14 forms two adjacent sides extended on two different planes, and the first abutting edge 621 is correspondingly abutted against the two sides of the recess 14 when the switch mechanism 60 is in the lock position. The first abutting edge 621 is substantially L shaped. Moreover, the block 62 includes the second abutting edge 622 abutted against the abutting side 21 of the driving head 20 when the switch mechanism 60 is in the lock position. The switch member 61 has an input section 611 and a fixing section 612. The fixing section 612 is inserted into the slot 28 and joined to the block 62. The block 62 includes an aperture 623 defined therein joining the fixing section 612 of the switch member 61.

In view of the forgoing, the first spring 30 has a first inside spring diameter, and the second spring 40 has a second inside spring diameter larger than the first inside spring diameter. The second spring 40 is disposed inside the first spring 30, and coils of the second spring 40 are disposed within a space delimited by the coils of the first spring 30. The first and second springs 30 and 40 include the first ends thereof received in the notch 11 inset in the handle 10 and the second ends thereof abutted against the fixed jaw 22 of the driving head 20, respectively. Additionally, one of the first and second springs 30 and 40 is coiled clockwise from the first end to the second end thereof, and the other of the first and second springs 30 and 40 is coiled counterclockwise from the first end to the second end thereof. The combination of the first and second springs 30 and 40 better assist relative movements of the handle 10 with respect to the fixed jaw 22. Also, both the first and second springs 30 and 40 will not become distorted easily.

While the specific embodiments have been illustrated and described, numerous modifications come to mind without significantly departing from the spirit of invention, and the scope of invention is only limited by the scope of the accompanying claims.

What is claimed is:

1. An adjustable wrench comprising:

a handle for a user to grasp when operating the adjustable wrench, with the handle having an outer periphery thereof including a notch and a concavity defined therein, with the concavity including an arcuate section;

a driving head pivotally fixed about a pivot axis to the handle for engaging an object that is driven by the adjustable wrench, wherein the driving head includes a fixed jaw and a movable jaw movably engaged with the fixed jaw, and an adjusting mechanism engaged with the movable jaw and operably movable to move the movable jaw to a predetermined position with respect to the fixed jaw, wherein the handle and the driving head include an abutting member engaged therebetween releasably engaged with the adjusting mechanism, with the abutting member engaged with the adjusting mechanism when the adjustable wrench is operated in the first direction, with the abutting member disengaged from the adjusting mechanism when the adjustable wrench is operated in the second direction, with the abutting member including a fixed end of an arcuate shape corresponding to and for axial slideable receipt in the arcuate section of the concavity while preventing movement of the abutting member in a radial direction out of the arcuate section of the concavity, wherein the fixed end of the abutting member is pivotally engaged in the arcuate section of the concavity of the handle; and first and second springs engaged between the driving head and the handle, with the first and second springs each including a first end abutting against the handle and a second end abutting against the driving head, respectively, with the notch receiving the first and second springs, with coils of the second spring disposed within a space delimited by coils of the first spring, with one of the first and second springs coiled clockwise from the first end to the second end thereof, with another of the first and second springs coiled counterclockwise from the first end to the second end thereof;

wherein the adjustable wrench is operable in a first direction wrenching the object and including the driving head not moving relative to the handle, and in a second direction moving relative to the object and including the driving head pivotally moving relative to the handle with the first and second springs each having a longitudinal length changing between a released length and depressed length, thereby assisting relative movement therebetween.

2. The adjustable wrench as claimed in claim 1, wherein the handle has the outer periphery defining an abutting edge which defines a first abutting surface and a second abutting surface and including the notch defined therein, wherein the first abutting surface is oblique to the second abutting surface, and wherein the driving head has an abutting side opposite the abutting edge and abutting against the first and second springs extended out of the first abutting surface and the second abutting surface.

3. The adjustable wrench as claimed in claim 2 further comprising a switch mechanism engaged between the handle and the driving head and operably moveable to a lock position in which the adjustable wrench is adapted to be operated clockwise or counterclockwise to wrench the object and includes the driving head prevented from moving relative to the handle, and to an unlock position in which the adjustable wrench is adapted to be operated in the first direction to wrench the object and includes the driving head prevented from moving relative to the handle, and in the second direction to move relative to the object and includes the driving head pivotal to the handle.

4. The adjustable wrench as claimed in claim 3, wherein the handle includes the outer periphery thereof including a recess defined therein, and wherein the switch mechanism includes a block releasably retained in the recess, with the switch mechanism in the lock position thereof including the block retained in the recess, and in the unlock position thereof including the block not retained in and disposed outside the recess.

5. The adjustable wrench as claimed in claim 1, wherein the first and second springs are located in a plane perpendicular to the pivot axis, wherein the handle includes a first orifice and the driving head includes a second orifice defined therein respectively, and wherein the handle and the driving head are pivotally joined together about the pivot engaged in the first and second orifices.

6. The adjustable wrench as claimed in claim 5, wherein the pivot is inserted through where the handle and the driving head overlaps, with one of the handle and the driving head having two sides and a gap defined therebetween, with another of the handle and the driving head including a protrusion received in the gap and overlapped with the two sides delimiting the gap.

7. The adjustable wrench as claimed in claim 6 further comprising a switch mechanism engaged between the handle and the driving head and operably moveable to a lock position in which the adjustable wrench is adapted to be operated clockwise or counterclockwise to wrench the object and includes the driving head prevented from moving relative to the handle, and to an unlock position in which the adjustable wrench is adapted to be operated in the first direction to wrench the object and includes the driving head prevented from moving relative to the handle, and in the second direction to move relative to the object and includes the driving head pivotal to the handle.

8. The adjustable wrench as claimed in claim 7, wherein the handle includes the outer periphery thereof including a recess defined therein, and wherein the switch mechanism includes a block releasably retained in the recess, with the switch mechanism in the lock position thereof including the block retained in the recess, and in the unlock position thereof including the block not retained in and disposed outside the recess.

9. The adjustable wrench as claimed in claim 1, wherein the adjusting mechanism includes a fixing member moveably retained in the driving head, wherein the fixing member has an outer periphery forming a first grooved section and two segments each having an external diameter greater than the first grooved section and respectively extended from two terminal ends of the first grooved section, and wherein the abutting member has an end immovable relative to the fixed end and engaged in the first grooved section when the adjustable wrench is operated in the first direction and disengaged from the first grooved section when the adjustable wrench is operated in the second direction, respectively.

10. The adjustable wrench as claimed in claim 9, wherein the fixing member includes a first biasing member and a worm gear mounted thereon, wherein the worm gear is engaged with and subject to a biasing force of the first biasing member, wherein the worm gear is rotatable and movable axially on the fixing member, wherein the worm gear is engaged with the movable jaw, and wherein the movable jaw is moved with respect to the fixed jaw when the worm gear is operably moved.

11. The adjustable wrench as claimed in claim 10 further comprising a switch mechanism engaged between the handle and the driving head and operably moveable to a lock position in which the adjustable wrench is adapted to be operated clockwise or counterclockwise to wrench the object and includes the driving head prevented from moving relative to the handle, and to an unlock position in which the adjustable wrench is adapted to be operated in the first direction to wrench the object and includes the driving head prevented from moving relative to the handle, and in the second direction to move relative to the object and includes the driving head pivotal to the handle.

12. The adjustable wrench as claimed in claim 11, wherein the handle includes the outer periphery thereof including a recess defined therein, and wherein the switch mechanism includes a block releasably retained in the recess, with the switch mechanism in the lock position thereof including the block retained in the recess, and in the unlock position thereof including the block not retained in and disposed outside the recess.

13. The adjustable wrench as claimed in claim 9 further comprising a switch mechanism engaged between the handle and the driving head and operably moveable to a lock position in which the adjustable wrench is adapted to be operated clockwise or counterclockwise to wrench the object and includes the driving head prevented from moving relative to the handle, and to an unlock position in which the adjustable wrench is adapted to be operated in the first direction to wrench the object and includes the driving head prevented from moving relative to the handle, and in the second direction to move relative to the object and includes the driving head pivotal to the handle.

14. The adjustable wrench as claimed in claim 13, wherein the handle includes the outer periphery thereof including a recess defined therein, and wherein the switch mechanism includes a block releasably retained in the recess, with the switch mechanism in the lock position thereof including the block retained in the recess, and in the unlock position thereof including the block not retained in and disposed outside the recess.

15. The adjustable wrench as claimed in claim 13, wherein one of the two terminal ends of the first grooved section includes a chamfered edge; and wherein the end of the abutting member includes a chamfered corner abutting with the chamfered edge when the adjustable wrench is operated in the first direction, with the abutting member moveable out of the first grooved section due to the chamfered edge and the chamfered corner.

16. The adjustable wrench as claimed in claim 9, wherein one of the two terminal ends of the first grooved section includes a chamfered edge; and wherein the end of the abutting member includes a chamfered corner abutting with the chamfered edge when the adjustable wrench is operated in the first direction, with the abutting member moveable out of the first grooved section due to the chamfered edge and the chamfered corner.

17. The adjustable wrench as claimed in claim 9, wherein the concavity further includes first and second inclined sections extended from two distal ends of the arcuate section to the outer periphery of the handle to increase a pivotal range of the abutting member.

18. The adjustable wrench as claimed in claim 17, wherein one of the two terminal ends of the first grooved section includes a chamfered edge; and wherein the end of the abutting member includes a chamfered corner abutting with the chamfered edge when the adjustable wrench is operated in the first direction, with the abutting member moveable out of the first grooved section due to the chamfered edge and the chamfered corner.

19. The adjustable wrench as claimed in claim 1 further comprising a switch mechanism engaged between the handle and the driving head and operably moveable to a lock position in which the adjustable wrench is adapted to be operated clockwise or counterclockwise to wrench the object and includes the driving head prevented from moving relative to the handle, and to an unlock position in which the adjustable wrench is adapted to be operated in the first direction to wrench the object and includes the driving head prevented from moving relative to the handle, and in the second direction to move relative to the object and includes the driving head pivotal to the handle.

20. The adjustable wrench as claimed in claim 19, wherein the handle includes the outer periphery thereof including a recess defined therein, and wherein the switch mechanism includes a block releasably retained in the recess, with the switch mechanism in the lock position thereof including the block retained in the recess, and in the unlock position thereof including the block not retained in and disposed outside the recess.

* * * * *